US006260623B1

(12) United States Patent
Schick

(10) Patent No.: US 6,260,623 B1
(45) Date of Patent: Jul. 17, 2001

(54) APPARATUS AND METHOD FOR UTILIZING FLEXIBLE TUBING WITH LATERAL BORE HOLES

(75) Inventor: Robert C. Schick, The Woodlands, TX (US)

(73) Assignee: KMK Trust, The Woodlands, TX (US)

( * ) Notice: Subject to any disclaimer, the term of this patent is extended or adjusted under 35 U.S.C. 154(b) by 0 days.

(21) Appl. No.: 09/364,922

(22) Filed: Jul. 30, 1999

(51) Int. Cl.[7] ..... E21B 7/08

(52) U.S. Cl. ..... 166/313; 166/50; 166/385; 175/62; 175/81

(58) Field of Search ..... 166/313, 385, 166/50, 187; 175/61, 62, 73, 75, 78, 79, 81

(56) References Cited

U.S. PATENT DOCUMENTS

| | | | |
|---|---|---|---|
| 2,839,270 | | 6/1958 | McCune et al. . |
| 4,094,360 | | 6/1978 | Nelson . |
| 4,130,162 | | 12/1978 | Nelson . |
| 4,304,299 | | 12/1981 | Holland et al. . |
| 4,307,780 | | 12/1981 | Curington . |
| 4,527,639 | | 7/1985 | Dickinson, III et al. . |
| 4,640,362 | | 2/1987 | Schellstede . |
| 4,658,916 | * | 4/1987 | Bond ..... 175/81 |
| 4,790,384 | | 12/1988 | Schellstede et al. . |
| 4,928,757 | | 5/1990 | Schellstede et al. . |
| 5,183,111 | | 2/1993 | Schellstede . |
| 5,215,151 | | 6/1993 | Smith et al. . |
| 5,253,718 | | 10/1993 | Lawler . |
| 5,346,017 | | 9/1994 | Blount et al. . |
| 5,373,906 | | 12/1994 | Braddick . |
| 5,379,845 | | 1/1995 | Blount . |
| 5,392,858 | | 2/1995 | Peters et al. . |
| 5,409,060 | | 4/1995 | Carter . |
| 5,413,184 | | 5/1995 | Landers . |
| 5,427,177 | | 6/1995 | Jordan, Jr. et al. . |
| 5,435,392 | | 7/1995 | Kennedy . |
| 5,435,400 | | 7/1995 | Smith . |
| 5,439,066 | | 8/1995 | Gipson . |
| 5,467,819 | | 11/1995 | Braddick . |
| 5,488,989 | | 2/1996 | Leising et al. . |
| 5,564,503 | | 10/1996 | Longbottom et al. . |
| 5,579,829 | | 12/1996 | Comeau et al. . |
| 5,647,437 | | 7/1997 | Braddick et al. . |
| 5,697,445 | | 12/1997 | Graham . |
| 5,704,437 | | 1/1998 | Murray . |
| 5,715,891 | | 2/1998 | Graham . |
| 5,735,350 | | 4/1998 | Longbottom et al. . |
| 5,740,864 | | 4/1998 | de Hoedt et al. . |
| 5,791,417 | | 8/1998 | Haugen et al. . |
| 5,807,704 | | 2/1989 | Hsu et al. . |
| 5,853,056 | | 12/1998 | Landers . |
| 5,871,046 | | 2/1999 | Robison . |

* cited by examiner

*Primary Examiner*—William Neuder
(74) *Attorney, Agent, or Firm*—Shook, Hardy & Bacon L.L.P.; William P. Jensen

(57) ABSTRACT

An apparatus and method for utilizing a flexible tubing string (18) for forming and isolating a lateral entrance opening (23) to a lateral bore hole (25) from a main bore hole (10). A packer (38) mounted on the lower end of a tubular guide (40) has an elbow (56) between an upper central entrance opening (58) and a side exit opening (60). The packer (38) and tubular guide (40) are lowered within the main bore hole (10) to a predetermined depth and azimuth for side exit opening (60) which is positioned adjacent the proposed lateral bore hole (25). Packer (38) is then inflated. The flexible tubing string (18) having a hole forming member on its lower end is lowered within tubular guide (40) and elbow (56) for forming the lateral entrance opening (23, 24) for the lateral bore hole (25) with opening (23, 24) isolated.

33 Claims, 4 Drawing Sheets

APPARATUS AND METHOD FOR UTILIZING FLEXIBLE TUBING WITH LATERAL BORE HOLES

FIELD OF THE INVENTION

This invention relates to an apparatus and method for utilizing flexible tubing with lateral bore holes, and more particularly to such an apparatus and method in which flexible tubing is directed laterally through a passage in a packer into a lateral bore hole extending from a main well bore.

BACKGROUND OF THE INVENTION

Heretofore, flexible tubing has been directed laterally through a lateral opening in casing about a main well bore and an elbow has been lowered within the casing to receive the flexible tubing for being directed laterally by the elbow through a lateral opening in the casing for penetrating the surrounding formation. A lateral opening is normally utilized by flexible or coiled tubing for a lateral bore hole in an area of the formation adjacent the opening. A casing may be perforated at different heights in the same pay zone and fluids may be communicated between the perforated areas into the adjacent formation.

It is desirable for certain procedures that lateral bore hole openings for separate lateral bore holes at a similar depth be isolated from each other to prevent fluid communication between different lateral bore holes and to permit different treatments in formations adjacent different lateral openings.

After drilling of a lateral bore hole from a main bore hole, the flexible tubing is withdrawn from the main bore hole and removed to another site. To reenter the main bore hole and utilize a selected lateral opening existing in the casing for identifying a specific lateral bore hole such as required for a well stimulation procedure utilizing coiled tubing, for example, the elbow receiving the flexible tubing must be precisely aligned with the existing lateral opening for the lateral bore hole.

It is an object of the invention to provide a packer for a well bore hole having a lateral opening for a lateral bore hole, the packer sealing about the lateral opening in an inflated position and having a passage therein for guiding flexible tubing from the main bore hole through the lateral opening for the lateral bore hole into the adjacent formation.

A further object of the invention is to provide an orienting structure in the main bore hole below the packer for orienting the packer in the event it is desired to reenter or isolate the lateral bore hole such as required for well stimulation, for example.

SUMMARY OF THE INVENTION

The present invention is directed particularly to an apparatus and method for forming and sealing about a lateral entrance opening to a lateral bore hole utilizing flexible tubing received within an elbow of the packer. The packer has a curved passage therein formed between an upper central entrance opening and a lower side exit opening to receive flexible tubing from the main bore hole and direct the flexible tubing laterally through the exit opening in the packer for forming the lateral entrance opening for the lateral bore hole. The packer is effective upon inflation to seal about the lateral entrance opening in the main bore hole to prevent flow in the annulus or flow to other lateral openings extending from the main bore hole. This permits isolation of the formation adjacent the sealed lateral opening from other areas of the formation as may be desirable for different strata or conditions encountered adjacent other lateral openings in the main bore hole or for different treatments of different strata. The flexible tubing may be utilized for several functions, such as cutting a lateral opening in the casing, water jetting of the formation, or injecting the formation with various fluids, for example.

An orienting structure may be mounted in the bore hole or casing for positioning the packer at a predetermined depth and predetermined angular position in a lateral direction. The orienting structure which is secured within the bore hole at a predetermined depth has a central bore with an orienting key therein and a stinger on the lower end of the packer is guided within the central bore by a tapered cam surface engaging the key. The packer is rotated by the key about its longitudinal axis to the desired angular relation and seated on the orienting structure so that the lateral exit opening of the packer is in axial alignment with the desired lateral opening in the casing for sealing about the lateral opening upon inflation of the packer at the seated position. A gyroscopic orientation tool may be utilized for the initial positioning of the packer without the utilization of an orienting structure. The orientation tool is run in the bore hole by an electric wireline for determining the proper depth and proper orientation as well known. However, in the event it is desired to reenter the well after the packer has been withdrawn, the orientation structure is required including a bridge plug and associated orienting key for alignment of the packer at the predetermined depth and azimuth.

Other objects, features, and advantages of the invention will be apparent from the following specification and drawings.

DESCRIPTION OF THE PREFERRED EMBODIMENTS

Embodiment of FIGS. 1–5

Figure 1:
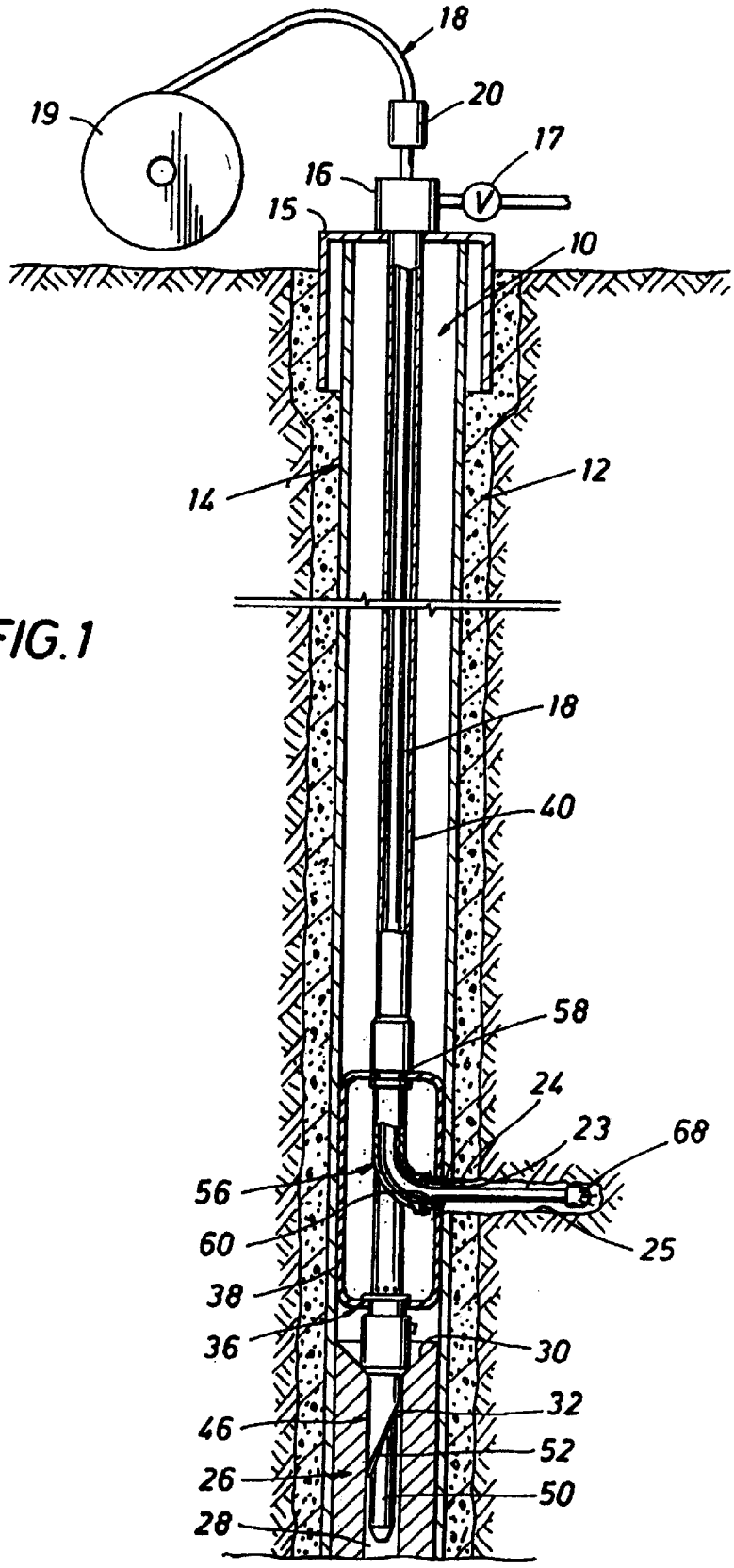
FIG. 1 is a longitudinal sectional view of a main well bore having a casing therein with a lateral opening in the casing directed to a lateral well bore and showing a packer having a passage therein with a side exit opening aligned with a previously formed lateral opening in the casing to direct flexible tubing into the lateral well bore.

Referring now to the drawings, and more particularly to the embodiment shown in FIGS. 1–5, a main bore hole is shown generally at 10 extending a predetermined depth in formation 12 and having an outer casing 14 therein with an outer cement liner 11. An upper surface casing is shown at 15 and a well head is shown schematically at 16 having a valve 17 extending therefrom. A coiled tubing string generally indicated at 18 extends from a reel 19 and injector 20 downwardly within casing 14 as will be further explained.

Casing 10 has a lateral opening 24 therein arranged at a precise position for the penetration of the lateral bore hole 25 at a precise depth and angle orientation and having an entrance opening 23 for the cement liner 11 and the adjacent formation. Lateral casing opening 24 may be formed by coiled tubing string 18 having a suitable cutting device thereon. A gyroscopic orientation tool such as sold by Baker Hughes Inteq. under the name "Seeker Surveying System" may be utilized for orientation. A suitable wireline provides power for the gyroscopic tool as well known. Measuring tools for depth are normally gamma ray and a collar locator. Other types of orientation tools may be utilized as well known.

As shown in the embodiment of FIGS. 1–5, a bridge plug generally indicated at 26 has been installed within casing 14 adjacent the bottom of bore hole 10 below lateral opening 24 at the desired depth and angular orientation as determined by the gyroscopic orientation tool. Bridge plug 26 has a central bore 28 and a tapered upper surface 30 leading to bore 28. An orientation key 32 is positioned in bore 28 at the predetermined depth and azimuth for forming lateral casing opening 24.

The apparatus for positioning coiled tubing string 18 at the desired depth and azimuth to form opening 24 in casing 14 at the desired lateral bore hole 25 is shown generally at 36. Apparatus 36 includes a packer 38 supported from a surface location by a tubular guide housing or member 40. An annulus 42 is defined between guide member 40 and casing 14. Guide member 40 has a support collar 44 bonded to packer 38 at the lower end of tubular guide housing 40 for rotative movement of packer 38 with tubular guide 40.

An orienting device generally indicated 46 is mounted on the lower end of packer 38 and has a collar 48 bonded to packer 38 for rotative movement with packer 38 and tubular guide housing 40. Orienting device 46 has a stinger 50 extending therefrom for being received within bore 28 of bridge plug 26. Stinger 50 has an enlarged diameter end portion 51 for seating on tapered surface 30 of bridge plug 26. A curved cam surface 52 extends about stinger 50 and upon lowering of orienting device 46, orienting key 32 contacts cam surface 52 for rotating packer 38 into proper alignment with the desired location of lateral opening 24. Orienting key 32 is received within slot 54 as shown in FIG. 3 with packer 38 rotated ninety (90) degrees from the position of FIG. 2 which shows packer 38 being lowered downwardly by tubular member 40 to the installed position of FIG. 3.

Packer 38 includes an elastomeric bladder having a rigid tubular mandrel between collars 44 and 48 defining an elbow generally indicated at 56 and a lower mandrel portion 53. Metal elbow 56 has a passage 57 with an upper entrance opening 58 and a lower side exit opening 60 which is in axial alignment with lateral opening 24 in casing 14 in an installed position. Passage 57 is curved for extending between upper entrance opening 58 and lower side exit opening 60 to provide for flexing and bending of coiled tubing string 18 by metal elbow 56 for forming lateral opening 24 at the desired lateral bore hole 25. A sleeve 62 is bonded to packer 38 to define side exit opening 60. Sleeve 62 is mounted for limited sliding movement relates to an enlarged diameter end portion 64 on elbow 56. Suitable O-ring seals are provided between sleeve 62 and enlarged diameter end 64 to permit relative movement as may occur during inflating of packer 38 in the installed position shown in FIG. 3.

Figure 4:
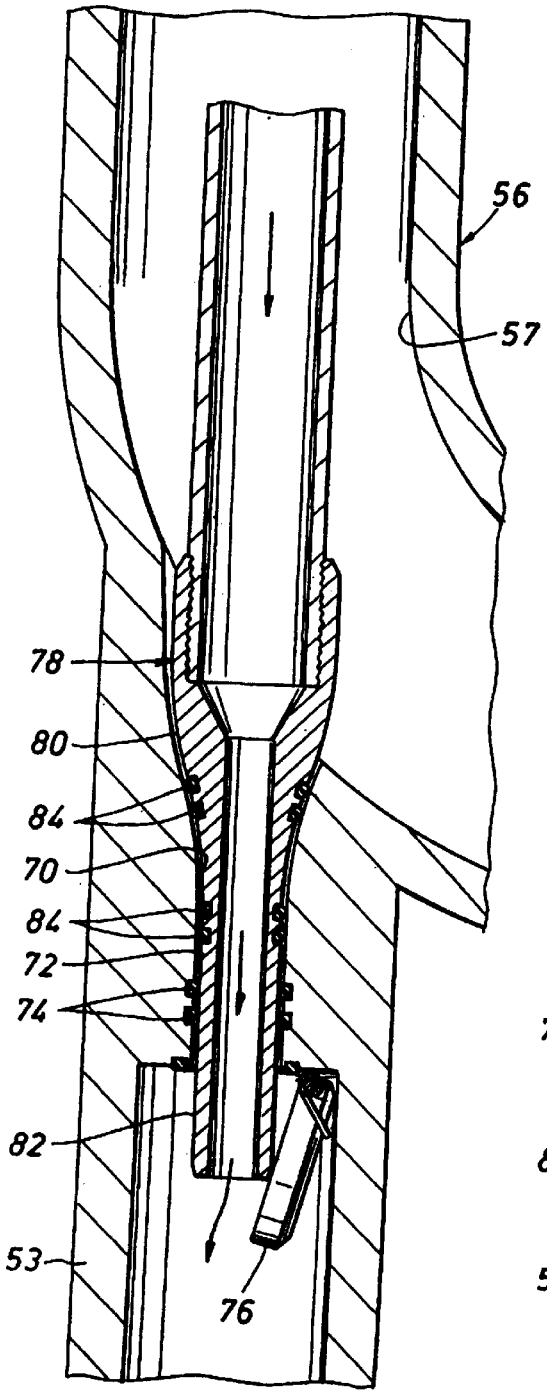
FIG. 4 is an enlarged sectional view of the packer positioned for fluid inflation by a stinger on the lower end of a coiled tubing string.

Elbow 56 and lower tubular mandrel portion 53 provide axial rigidity to packer 38. Tubular mandrel portion 53 having lower openings 57 is utilized to supply fluid to packer 38 for expanding packer 38 outwardly into sealing relation with casing 14 prior to formation of lateral opening 24. For this purpose, a tapered opening 70 leads to a lower filler passage 72 having internal lower annulus seals 74 as shown in FIG. 4. A flapper type back pressure valve 76 is mounted on the lower end of filler passage 72. For opening back pressure valve 76, a rigid stinger generally indicated at 78 is mounted on the lower end of a coiled tubing string and has an outer tapered surface 80 extending to a lower end portion 82. Annular seals 84 are provided about tapered surface 80 and lower end portion 82. Upon lowering of stinger 78 within opening 75, lower end portion 82 and tapered surface 80 are received within filler passage 72 with tapered surface 80 in mating relation with tapered opening 70. A suitable filler fluid is discharged from the lower end portion 72 and openings 57 upon opening of back pressure valve 76 by stinger 78 or by fluid pressure from stinger 78. Upon reaching the predetermined fluid pressure within packer 38, stinger 78 is withdrawn and back pressure valve 76 is closed by fluid pressure. A suitable back pressure valve is a flapper type float valve sold by Baker Hughes, Inc. of Houston, Tex.

After inflating of packer 38 and removal of stinger 78 from filler passage 72, the coiled tubing string and stinger 78 are withdrawn from guide tube 40 and a suitable cutter is provided on the lower end of string 18 to form lateral opening 24 upon lowering of string 18 within elbow 56. A rotary cutter driven by a downhole motor is preferably utilized for forming lateral opening 24 at the desired entrance opening 23 for the lateral bore hole 25.

After forming lateral opening 24 in casing 14, flexible tubing string 18 is withdrawn from the main bore hole 10 and an injection or drilling member such as a water jet nozzle 68 is secured to the lower end of coiled tubing string 18 for being lowered within main bore hole 10. Rigid elbow 56 and lower mandrel portion 53 provide stability for coiled tubing string 18 in supporting coiled tubing string for cutting, drilling, or other operations. Other types of drilling or injecting devices, such as a rotating drilling head driven by a downhole motor for example, may be utilized on the end of the flexible tubing string, if desired. In some instances, fluid injection may be provided directly into lateral bore hole 25 without utilizing tubing string 18.

Figure 5:
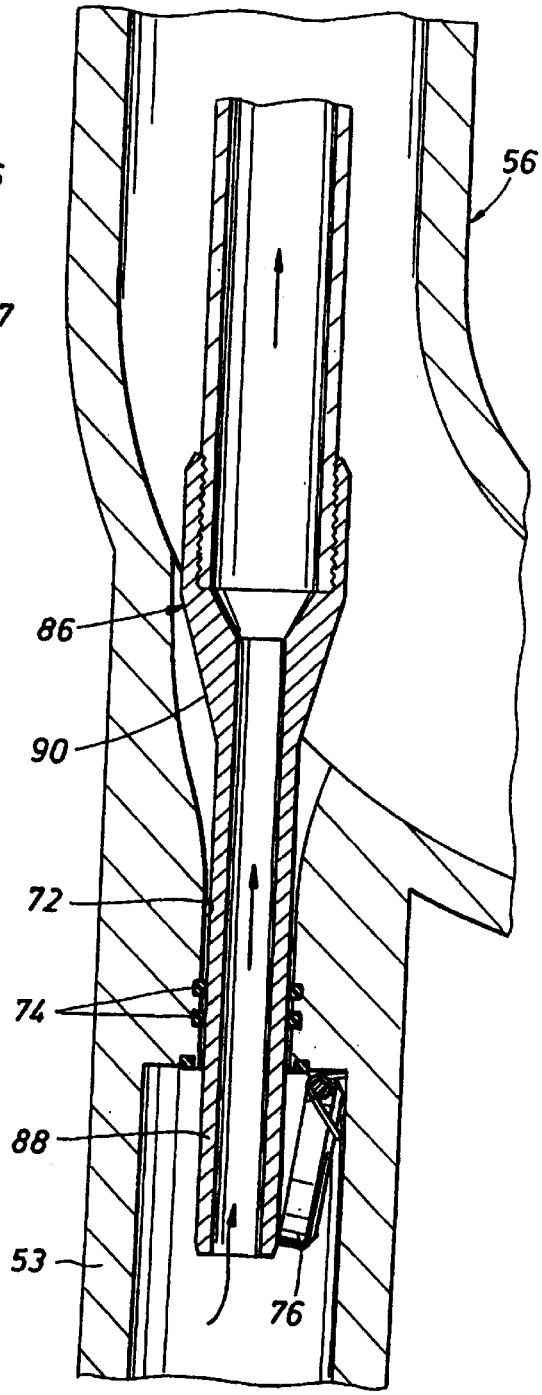
FIG. 5 is an enlarged sectional view of the packer positioned for deflation by a stinger engaging and opening a back pressure valve.

To deflate packer 38 as shown in FIG. 5, another rigid stinger 86 is provided on the lower end of coiled tubing or a wireline and has a relative long lower end portion 88 with a tapered surface 90. Lower end portion 88 is effective to contact and open flapper valve 76 to reduce the fluid pressure within packer 38.

It may be desirable to provide a lateral bore hole at another location at the same depth and a lateral opening 94 in opposed relation to opening 60 is shown in casing 14 in FIG. 3 for that purpose. If bridge plug 26 is utilized for orientation, orientation device 46 and guide 40 are withdrawn from bore hole 10 and cam sleeve 52 at the surface location is rotated the desired amount relative to stinger 50 upon actuation of release 96. Then, orientation device 40 can be lowered within bore hole 10 for seating on bridge plug 26 at the desired depth and azimuth. In the event a bridge plug 26 is not provided, packer 38 and tubular guide 40 may be rotated from a surface location for alignment with lateral opening 94 without removal of packer 38 and tubular guide 40 from the main bore hole.

Under some circumstances, an orienting device similar to that shown in U.S. Pat. No. 5,740,864 dated Apr. 21, 1998 could be utilized.

Figure 6:
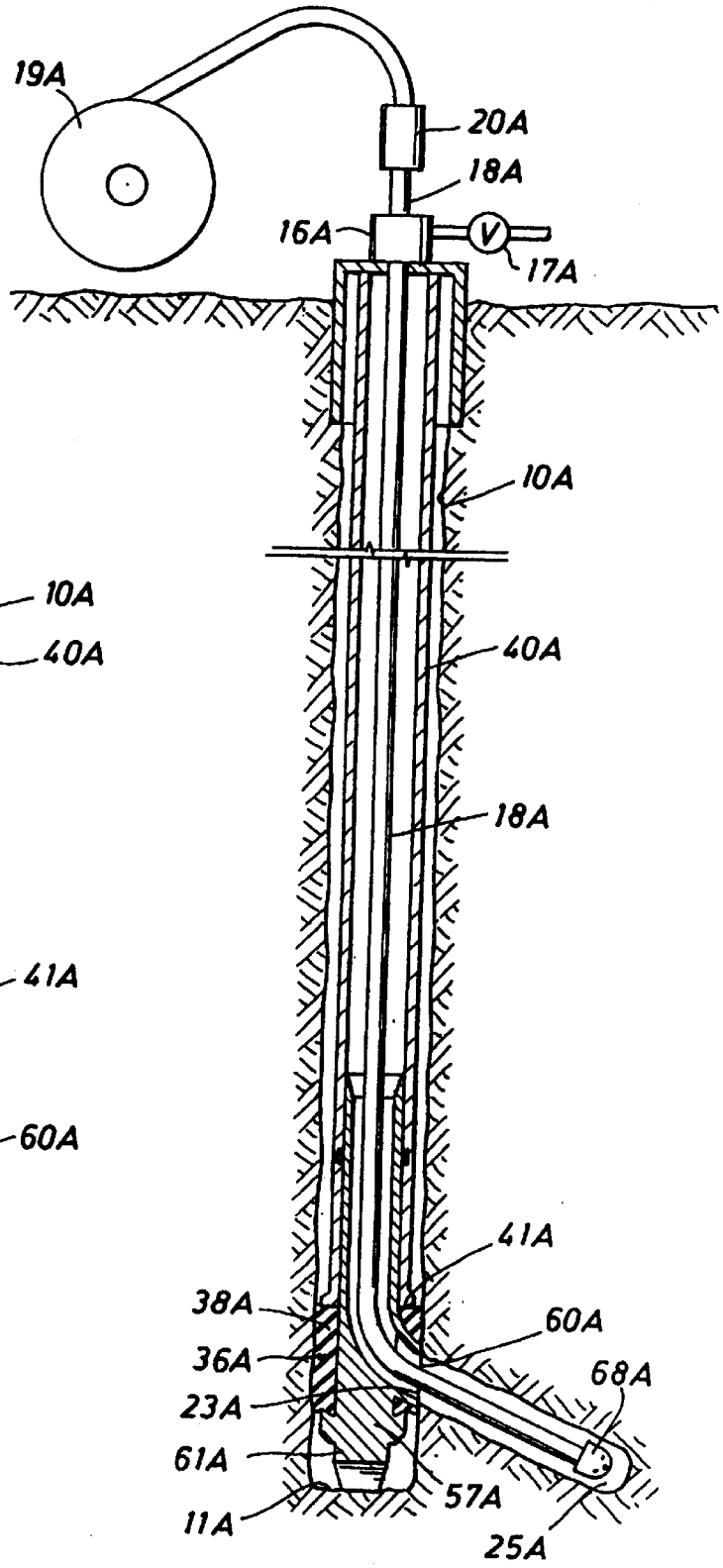
FIG. 6 is a longitudinal section of another embodiment of the invention in which an elastomeric packer is inflated within an open bore hole by compressive forces squeezing the packer outwardly into an installed position for forming and sealing about a lateral entrance opening for a lateral bore hole.
Figure 7:
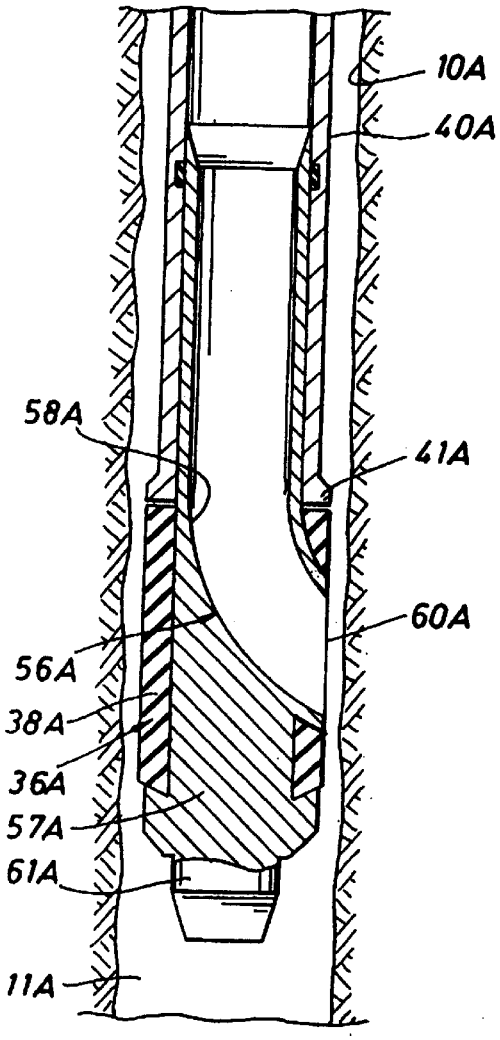
FIG. 7 is an enlarged sectional view of the elastomeric packer shown in FIG. 4 being lowered within the main bore hole for positioning at a predetermined depth to form the lateral entrance opening for the lateral bore hole.

Embodiment of FIGS. 6 and 7

The embodiment shown in FIGS. 6 and 7 illustrates the utilization of a packer inflated by compressive forces and positioned within an open or uncased bore hole shown at 10A. A coiled tubing string 18A extends within bore hole 10A from a coiled tubing reel 19A. Coiled tubing string 18A is received within a tubular guide 40A extending downwardly from wellhead 16A. The lower end of tubular guide 40A has an annular shoe 41 A. Packer 36A includes a metal body 57A forming elbow 56A with entrance opening 58 and lateral exit opening 60A. A metal foot 61A is secured to the lower end of packer 36A for engaging the bottom 11A of bore hole 10A. However, any desired member may be attached to the lower end of packer 36A for positioning packer 36A at the desired depth, such as a pipe extension, for example. Packer 36A has an elastomeric sleeve 38A extending about body 57A and about lateral exit opening 60A. Packer 36A including elbow 56A is mounted for axial movement relative to guide tube 40A. To expand or inflate elastomeric sleeve 38A after foot 61A engages bottom 11A of bore hole 10A, a downward force is exerted against tubular guide 40A from a surface location for engagement of shoe 41A with elastomeric sleeve 38A to expand sleeve 38A to the position of FIG. 4. If desired, a suitable sleeve similar to sleeve 62 of the embodiment shown in FIGS. 1–5 may be provided for elbow 56.

Bore hole 10A has a lateral entrance opening 23A for lateral bore hole 25A. Packer 36A is lowered within bore hole 10A by tubular guide 40A with foot 61A contacting bottom 11A of bore hole 10A at the desired location of lateral entrance opening 23A. Downward force on guide 40A after foot 61 A engages bottom 11A inflates elastomeric sleeve 38A for sealing about the desired lateral entrance 23A opening as shown in FIG. 4 in the installed position of packer 36A. After installation of packer 36A, coiled tubing 18A is inserted.

Coiled tubing 18A has a water jet 68A on its lower end for forming lateral entrance opening 23A and lateral bore hole 25A. Tubular guide 40A maintains a sufficient force against packer 36A for sealing about lateral opening 23A. A suitable assembly for expanding packer 36A is sold as a type RN (Non-Rotating) Expanding Shoe Packer Assembly by Halliburton, Houston, Tex.

While packer 36A has been illustrated for use in an open or uncased bore hole, packer 36A could be used in a cased bore hole and could be compressed against a bridge plug in the casing instead of the bottom of the bore hole as shown in FIG. 4. Further, the fluid inflated packer 38 shown in FIGS. 1–3 could be used in an uncased or open bore hole.

Figure 2:
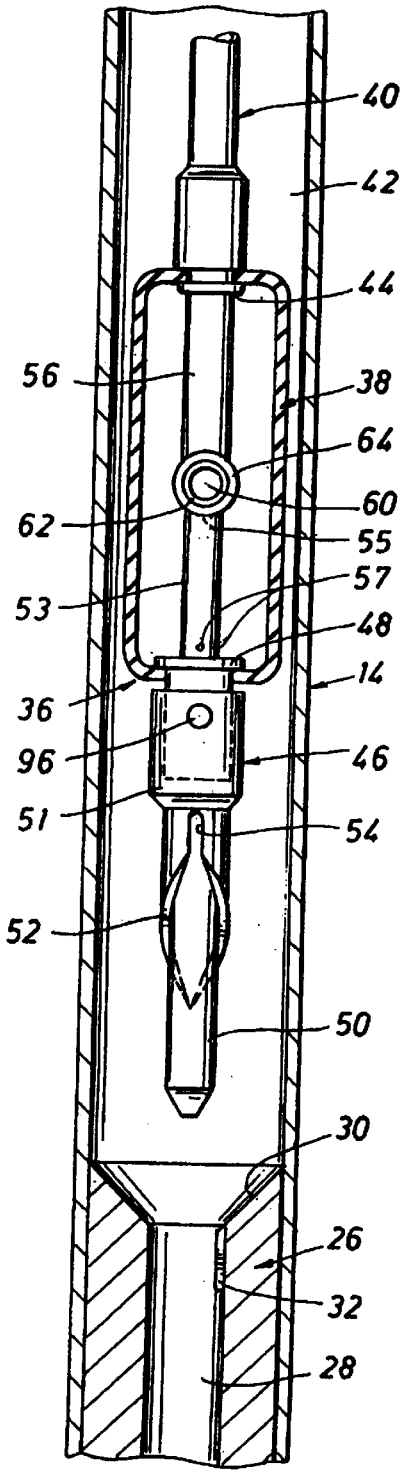
FIG. 2 is an enlarged sectional view of the lower end of the main well bore shown in FIG. 1 showing the packer supported by a tubular guide and being lowered into the main well bore for orientation by a bridge plug and installation adjacent a proposed lateral casing opening.
Figure 3:
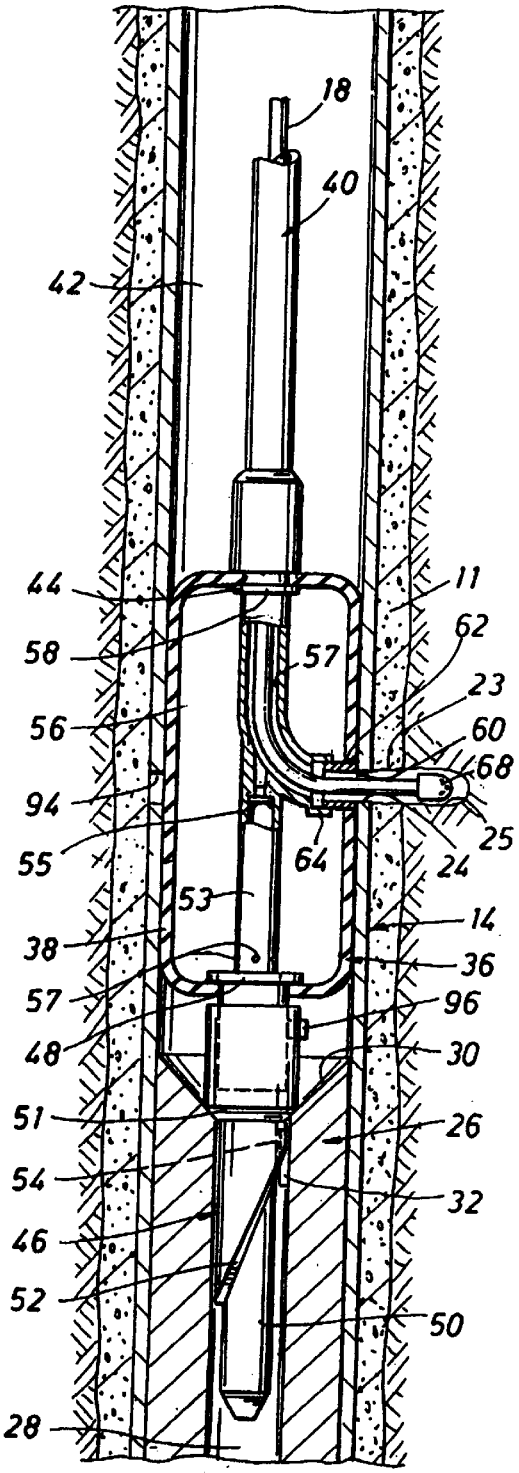
FIG. 3 is an enlarged sectional view of the lower end of the main well bore showing the packer inflated by fluid and seated on the lower bridge plug in an oriented installed position sealing about the previously formed lateral opening in the casing.

While bridge plug 26 is shown in the embodiment of FIGS. 1–3, packer 38 could be utilized without bridge plug 26. However, in the event it is desired to reenter the main bore hole after the apparatus has been removed, bridge plug 26 would be required in order to accurately orient packer 38 with casing opening 24 at the predetermined depth and azimuth.

While preferred embodiments of the present invention have been illustrated in detail, it is apparent that modifications and adaptions of the preferred embodiments will occur to those skilled in the art. However, it is to be expressly understood that such modifications and adaptations are within the spirit and scope of the present invention as set forth in the following claims.

What is claimed is:

1. Apparatus for forming and isolating a lateral entrance opening extending from a main bore hole to a lateral bore hole, said apparatus comprising:

a tubular guide member extending within said main bore hole;

a packer mounted on the lower end of said tubular guide member and having a passage therethrough including an upper central entrance opening and a side exit opening for positioning at a predetermined depth and azimuth, said packer being inflated upon positioning of said side exit opening at said predetermined depth and azimuth for said lateral entrance opening; and flexible tubing within said guide member extending through said passage in said packer and out said side exit opening, said flexible tubing having a hole forming member on its lower end for forming said lateral entrance opening for the adjacent formation, said packer sealing about and isolating said lateral entrance opening.

2. Apparatus as defined in claim 1 wherein said main bore hole is an open uncased hole, and said lateral entrance opening is in the formation adjacent said side exit opening.

3. Apparatus as defined in claim 1 wherein an outer casing is provided about said main bore hole, and said lateral entrance opening is provided in said casing adjacent said side exit opening.

4. Apparatus as defined in claim 1 further comprising a metal tube in said packer forming said passage.

5. Apparatus as defined in claim 4 wherein said packer includes a fluid inflatable bladder for sealing about and isolating said lateral entrance opening.

6. Apparatus as defined in claim 4 wherein said packer includes an elastomeric member about said metal tube, said elastomeric member when inflated being compressed and squeezed outwardly for sealing about said lateral entrance opening.

7. Apparatus as defined in claim 1 wherein said main bore hole has a plurality of lateral entrance openings at substantially the same depth, and said packer upon deflation is movable from one selected lateral entrance opening to another selected lateral opening and reinflated for sealing about and isolating said another selected lateral entrance opening in said main bore hole.

8. Apparatus as defined in claim 1 further comprising an orienting structure mounted within said main well bore below said packer, said packer having a member contacting said orienting structure for positioning said packer at a predetermined depth and azimuth within said main well bore.

9. Apparatus as defined in claim 8 wherein said orienting structure includes a key and said packer member includes a slot receiving said key in an aligned position.

10. Apparatus for forming and isolating a lateral entrance opening in a casing from a main well bore to a lateral well bore; said apparatus comprising:

a tubular guide member extending within said casing;

a packer mounted on the lower end of said tubular guide member having a rigid elbow therein including an upper central entrance opening and a side exit opening;

flexible tubing extending down said tubular guide member through said rigid elbow in said packer and out said side exit opening; said packer upon inflation being squeezed outwardly into sealing engagement with said casing; and a member on the end of said flexible tubing for forming said lateral entrance opening after said packer is inflated with said packer sealing about and isolating said lateral entrance opening to said lateral bore hole.

11. Apparatus as defined in claim 10 wherein said rigid elbow comprises a metal tube.

12. Apparatus as defined in claim 10 wherein said packer includes a fluid inflatable bladder for sealing about said lateral entrance opening.

13. Apparatus defined in claim 10 wherein said packer includes an elastomeric member about said elbow, said elastomeric member being compressed and squeezed outwardly for sealing about said lateral entrance opening.

14. Apparatus as defined in claim 10 further comprising a sliding sleeve mounted about said lateral exit opening for sliding movement relative to said rigid elbow.

15. The apparatus as defined in claim 10 further comprising:

an orienting structure mounted within said casing below said packer and said lateral entrance opening in said casing, said packer engaging said orienting structure upon installation to position said packer at a predetermined depth and azimuth within said casing for forming said lateral entrance opening in the casing.

16. The apparatus as defined in claim 15 wherein said orienting structure comprises a bridge plug positioned within said casing at a predetermined depth and having a key therein for engagement with said packer to align said exit opening.

17. The apparatus as defined in claim 16 wherein said bridge plug has a central bore and an inwardly tapering upper surface about said cental bore, and said packer has a guide projecting downwardly for guiding said packer onto said upper surface.

18. Apparatus for locating a lateral opening for a lateral well bore extending from a main well bore; said apparatus comprising:

an orienting structure mounted within said main well bore at a predetermined depth;

a packer structure supported on said orienting structure adjacent said lateral opening, said packer structure having a passage therethrough including an upper central entrance opening and a side exit opening axially aligned with said lateral opening for said lateral well bore, said packer being inflated for sealing about said lateral opening; and flexible tubing extending down said main well bore and through said passage and lateral opening into the formation adjacent said lateral opening.

19. The apparatus for locating a lateral opening as defining in claim 18 wherein cooperating orienting members are positioned on said packer structure and said orienting structure for aligning said exit opening and said lateral opening upon lowering of said packer structure onto said orienting structure at a predetermined depth of the main well bore.

20. Apparatus as defined in claim 18 further comprising a metal elbow forming said passage in said packer structure and having a slidable sleeve extending between said elbow and said exit opening of said packer structure.

21. A packer structure constructed for use with a coiled tubing structure for forming a lateral bore hole, said packer structure comprising:

a packer having a rigid elbow, a central entrance opening and a side exit opening arranged to receive a coiled tubing string therein, said packer having a fluid inflatable bladder for sealing about a lateral opening in a well bore aligned with the side exit opening.

22. A packer structure as set forth in claim 21 wherein said packer includes an outer elastomeric sleeve expandable outwardly upon compression for sealing about a lateral opening in a well bore aligned with the side exit opening.

23. An apparatus for locating a lateral opening for a well bore extending from a main well bore; said apparatus comprising:

an orienting structure mounted within said main well bore at a predetermined depth;

an elbow supported on said orienting structure adjacent said lateral opening, said elbow structure having a passage therethrough including an upper central entrance opening and a side exit opening axially aligned with said lateral opening for said lateral well bore; and cooperating orienting members positioned on said elbow and said orienting structure for aligning said exit opening and said lateral opening upon lowering of said elbow onto said orienting structure at a predetermined depth of the main well bore.

24. A method for locating and isolating a lateral opening to a lateral well bore from a main well bore comprising the steps of:

providing a packer having a continuous passage therein between an upper central entrance opening and a lower side exit opening;

mounting said packer on the lower end of a tubular guide;

lowering said packer and tubular guide within the main well bore to a predetermined depth at which said lateral well bore is desired;

inflating said packer for sealing about the proposed lateral opening in alignment with said side exit opening; and inserting flexible tubing within said tubular guide and said passage in said packer for bending said flexible tubing with the lower end of said flexible tubing extending through said side exit opening and for forming lateral opening for treatment of the formation.

25. The method defined in claim 24 further comprising the steps of:

providing a casing for the main well bore; and providing a rotary cutter on the lower end of said flexible tubing for cutting said lateral opening in said casing at the predetermined depth of the lateral well bore.

26. The method defined in claim 24 further comprising the step of providing a drilling member on the lower end of said flexible tubing for penetrating the formation adjacent the side exit opening of said packer.

27. The method defined in claim 24 further comprising the steps of:

positioning an orienting structure within the main well bore at a predetermined depth below the selected depth for the lateral well bore;

said step of lowering said packer and tubular guide including lowering said packer onto said orienting structure at a predetermined depth and azimuth with said exit opening axially aligned with said lateral well bore.

28. The method defined in claim 24 further comprising the steps of:

providing said packer with an elastomeric member for expanding radially outwardly upon compression thereof;

lowering said packer within said main bore hole onto a stop at which said lower side exit opening is axially aligned with said lateral opening; and applying a compressive force against said packer for sealing of said packer about said lateral opening.

29. A method of forming and isolating a lateral entrance opening to a lateral well bore from a main well bore comprising the following steps:

positioning a packer on the lower end of a tubular guide member, the packer having a continuous passage therethrough defining an upper central entrance opening and a side exit opening;

lowering the packer and tubular guide member within the main well bore to a predetermined depth and azimuth for said side exit opening adjacent the proposed lateral well bore;

inflating the packer to form an annular seal about the proposed lateral entrance opening to the lateral well bore; and inserting a flexible tubing string having a hole forming member on its lower end within said tubular guide and through said passage in said packer for forming said lateral entrance opening to said lateral well bore.

30. The method as set forth in claim 29 further comprising the steps of mounting an orienting structure within said main well bore at a predetermined depth; and providing cooperating members on said packer and said orienting structure for positioning said side exit opening of said packer at a predetermined depth and azimuth when said packer and tubular guide are lowered within said main bore hole and seated on said orienting structure.

31. The method as defined in claim 29 wherein the step of providing a packer includes providing a fluid inflatable packer for expanding said packer outwardly into sealing relation with the main bore hole at the proposed lateral bore hole.

32. The method as defined in claim 29 wherein the step of providing a packer includes providing a packer inflatable by a compressive force acting against opposed ends of the packer for inflating the packer outwardly into sealing relation with the main bore hole at the proposed lateral bore hole.

33. The method as defined in claim 30 including the steps of deflating said packer;

rotating said packer to another transverse position in which said exit opening is in axial alignment with another selected lateral opening for a lateral bore hole; and then inflating said packer for sealing about said another lateral opening.

* * * * *